US007498989B1

(12) United States Patent
Volman

(10) Patent No.: US 7,498,989 B1
(45) Date of Patent: Mar. 3, 2009

(54) STACKED-DISK ANTENNA ELEMENT WITH WINGS, AND ARRAY THEREOF

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 123 days.

(21) Appl. No.: 11/789,856

(22) Filed: Apr. 26, 2007

(51) Int. Cl.
*H01Q 1/38* (2006.01)

(52) U.S. Cl. ..... 343/700 MS; 343/846

(58) Field of Classification Search ..... 343/700 MS, 343/846
See application file for complete search history.

(56) References Cited

U.S. PATENT DOCUMENTS

| | | | | |
|---|---|---|---|---|
| 5,258,771 | A | 11/1993 | Praba | |
| 5,880,694 | A | 3/1999 | Wang et al. | |
| 6,020,852 | A * | 2/2000 | Jostell | 343/700 MS |
| 6,239,750 | B1 * | 5/2001 | Snygg | 343/700 MS |
| 6,639,558 | B2 * | 10/2003 | Kellerman et al. | 343/700 MS |
| 6,831,608 | B2 * | 12/2004 | Arvidsson | 343/700 MS |
| 6,919,862 | B2 * | 7/2005 | Hacker et al. | 343/909 |
| 2006/0164317 | A1 | 7/2006 | Hughes | |

OTHER PUBLICATIONS

"Input Impedance of a Probe-Fed Stacked Circular Microstrip Antenna"—Ann N. Tulintseff, Sami M. Ali, Senior Member, *IEEE*, and Jin Au Kong, *Fellow, IEEE*, no date avail.
IEEE Transactions on Antenna and Propagation , vol. AP-27, No. 2, Mar. 1979.

"A Lightweight, C-Band, Dual Circularly Polarized Microstrip Antenna For Satellite Applications"—L. Sichan, R.M. Sorbello, S. Siddigit, and J.I. Upshur COMSAT Laboratories Clarksburg, Maryland 20871-9475, no date available.
"Low Profile, Broadband, Wide-Scan, Circular-Polarized Phased Array Radiator"—Allen T.S. Wang, Ruey-Shi Chu, Kuan Min Lee Hughes Aircraft Co., Los Angeles, CA 90009, no date available.
"Low-Profile, Integrated Radiator Tiles for Wideband, Circular-Polarized Phased Array Applications"—Allen T.S. Wang, Kuan Min Lee, Loc Chau Raytheon Systems Co. Los Angeles, CA 90009, no date available.
A Dual-Frequency Stacked Circular-Disc Antenna, published by Long et al. at pp. 270-273 of IEEE Transactions on Antenna and Propagation, vol. AP-27, No. 2, Mar. 1979.
A Lightweight, C-Band, Dual Circular Polarized Microstrip Antenna for Satellite Applications, published by Sichan et al. at pp. 909-912 of the 1989 IEEE article CH2654-2/89/0000-0909.

* cited by examiner

*Primary Examiner*—Hoang V Nguyen
(74) *Attorney, Agent, or Firm*—Duane Morris LLP

(57) ABSTRACT

An antenna element includes a ground plane, a first conductive disk lying parallel with the ground plane and spaced therefrom, and a second conductive disk, larger than the first disk, more remote from the ground plane than the first disk. A electrical and thermal conducing element may make electrical and thermal contact with the ground plane and the first and second disks. A radome extends over the element and in thermal communication with the thermal element. A conductive or high-dielectric-constant planar wing is supported by the ground plane outside of the projection of the disks, with a central axis of the element lying in the plane of the wing. If two wings are present, one may be electrically conductive or dielectric and the other conductive or dielectric. The wings, when the element is arrayed, lie part-way between the centers of adjacent array elements.

51 Claims, 6 Drawing Sheets

STACKED-DISK ANTENNA ELEMENT WITH WINGS, AND ARRAY THEREOF

FIELD OF THE INVENTION

This invention relates to antenna elements and especially to antennas suitable for use in antenna arrays.

BACKGROUND OF THE INVENTION

Those skilled in the arts of antennas, antenna arrays and beamformers know that antennas are transducers which transduce electromagnetic energy between unguided and guided-wave forms. More particularly, the unguided form of electromagnetic energy is that propagating in "free space," while guided electromagnetic energy follows a defined path established by a "transmission line" of some sort. Transmission lines include coaxial cables, rectangular circular hollow conductive waveguides, dielectric paths, and strip conductors over ground. and the like. Antennas in principle are totally reciprocal devices, which have the same beam characteristics in both transmission and reception modes. For historic reasons, the guided-wave port of an antenna is termed a "feed" port, regardless of whether the antenna operates for transmission or reception. The beam characteristics of an antenna are established, in part, by the size of the radiating portions of the antenna relative to the wavelength. In general, small antennas make for broad or nondirective beams, and large antennas make for small, narrow or directive beams. When more directivity (narrower beamwidth) is desired than can be achieved from a single antenna, several antennas may be grouped together into an "array" and fed together in a phase-controlled manner, to generate the beam characteristics of an antenna larger than that of any single antenna element. The structures which control the phase and apportionment of power to (or from) the antenna elements are termed "beamformers." In general, a beamformer includes at least one beam port and a plurality of element ports. In a transmit mode, the signal to be transmitted is applied to the beam port and is distributed by the beamformer to the various element ports. In the receive mode, the unguided electromagnetic signals are received by the antenna elements and coupled in guided form to the element ports of the beamformer, and are combined in the beamformer to produce a beam signal at the beam port of the beamformer. A salient advantage of sophisticated beamformers is that they may include a plurality of beam ports, each of which distributes the electromagnetic energy in such a fashion that different antenna beams may be generated simultaneously.

Array antennas are well known for various communication and sensing purposes, and exhibit advantages over shaped-reflector antennas in that scanning of the beam or beams through spatial angles can be performed essentially instantaneously, without inertia problems associated with the moving of a discrete object. In order to perform its role of setting the direction of the antenna beam of an array, a beamformer must set the element-to-element phase of the signal being transduced. So long as the beam direction is fixed, fixed phase shifting elements may be used in the beamformer to set the element-to-element phase. Such phase shifting elements are ordinarily passive rather than active. Those skilled in the art know that passive elements are ordinarily very reliable. When the shape or direction of the array antenna beam must be controllable rather than fixed, it is customary to use controllable phase shifters in the beamformers. Controllable phase shifters may be analog or digital. Current designs prefer multibit digital types of phase shifters because they can be controlled by simple digital signals, and because the phase shifts can be readily and accurately set.

It will be appreciated that an array antenna, when used with a beamformer for transmitting signal, may require the application of significant power to the beam port(s) of the beamformer in order to achieve the desired power density in the radiated beam so formed. This power tends to be attenuated by the unavoidable "heating" or "ohmic" losses in the beamformer. It may be found to be desirable to distribute relatively small-amplitude signals through the beamformer, and to amplify the signal at the individual element ports of the beamformer before application to each element of the antenna array for transmission. Thus, the array antenna when used for transmission may require a "power" or "transmit" amplifier for each antenna array element or group of elements. When an array antenna is operated in a receiving mode, the signal received by each antenna element must pass through the beamformer before being combined with signals received by other antenna elements. Since the beamformer is subject to losses, the received signal tends to be attenuated by passage through the beamformer. This attenuation tends to undesirably reduce the signal-to-noise ratio of the combined received signal at the beam port of the beamformer. The signal-to-noise ratio can often be improved by amplifying the signal received by each antenna element in a low-noise amplifier before application of the signal to the beamformer.

Selection or control of the antenna beam of an array antenna also involves the "weighting" of the relative power applied to the various antenna elements of the array. The purpose of weighting is to establish the sidelobe level and the distribution of directivity as between the main antenna beam lobe(s) and unwanted subsidiary lobes. An unweighted distribution provides each antenna element of the array with equal weight, meaning that in a transmission mode of operation all antenna elements are excited with equal amplitude signals, and in a receive mode of operation the combining of the signals from the various antenna elements is made with equal amplitude. Such a uniform weighting may be desirable when maximum directivity or gain is desired. However, a uniform aperture distribution tends to result in significant sidelobe levels, which are about −13 dB to −18 dB relative to the peak of the main lobe. The sidelobes may be viewed as being an inherent defect of an antenna, in that they result in transmission of power in directions other than the desired direction, or reception of signals from directions other than that desired. Such transmission in unwanted directions can result in detection of the source of the signals by hostile forces, and in any case represents a waste of transmitter power toward regions of no interest. The reception of signals from undesired directions can expose the antenna to jamming signals from unknown directions. The prior art controls the sidelobe level of an antenna by weighting or adjusting the aperture field distribution. Examples of prior art weighting functions that produce low side lobe levels in the absence of element failures include raised-cosine weighting, Dolph-Tschebyscheff weighting, and Taylor weighting functions. Weighting in an array antenna is ordinarily a function of the beamformer. The distribution of signals in the beamformer may be accomplished by power dividers (or power combiners in receive mode) selected to give the desired array element weighting. In some instances, variable gain or attenuation may be used.

Thus, each antenna element of an array antenna may be associated with a "power" amplifier for use in a transmit mode, a "low-noise" amplifier for use in a receive mode, in addition to at least one phase shifter, and more than one phase shifter if the transmit beam direction may differ from the receive beam direction. The power amplifier, the low-noise amplifier, and the phase shifter(s) associated with each antenna element (or possibly subarray of antenna elements) are often combined into a "transmit-receive" (TR) module. This module, in addition to the amplifiers and phase shifter(s) may also include any controllable gain elements, radio-frequency (RF) switches for switching between transmit and receive modes of operation, controls for the switches, and power supplies for the various controls and active devices.

In the past, the term "radio frequency" was interpreted to mean a limited range of frequencies, such as, for example, the range extending from about 20 KHz to 2 MHz. Those skilled in the art know that "radio" frequencies as now understood extends over the entire frequency spectrum, including those frequencies in the "microwave" and "millimeter-wave" regions, and up to light-wave frequencies. Many of these frequencies are very important for commercial purposes, as they include the frequencies at which radar systems, global positioning systems, satellite cellular communications and ordinary terrestrial cellphone systems operate.

It will be appreciated that an array antenna, especially one containing thousands or tens of thousands of antenna elements, may be physically large. The large physical size, in turn, means that wind loading may impart strong forces to the structure and to the antenna elements themselves. It is common to protect the antenna elements by the use of a "radome." The "dome" aspect of the term "radome" comes from a time at which physically movable antennas were used for scanning, and the protective radomes were generally at least partially spherical. The radome is intended to protect the antenna elements from the environment, and may be planar if appropriate. Antenna elements which project significantly from their feed points, such as the axial helix antenna elements described in U.S. Pat. No. 5,258,771 issued Nov. 2, 1993 in the name of Praba, may be difficult to protect with a simple radome structure. Praba describes an antenna array operating in two disparate frequency bands, which uses interleaved axial-mode "helical" antenna elements. Each such helical antenna includes an electrically conductive element helically disposed about a longitudinal axis, with a feed point adjacent a ground plane disposed orthogonal to the axis of the helix. Such helical antenna elements are well known, and have the advantage, when so fed against a ground plane, of providing moderately high gain, together with circular polarization. In order to reduce the interaction between the helical antenna elements of the arrays at the disparate frequencies as described by Praba, the helices of the two interleaved arrays are oppositely wound, so that a right-circularly-polarized antenna element is adjacent a left-circularly-polarized antenna element, which results in some degree of rejection of the cross-polarization signal from the adjacent elements, and thereby tends to reduce mutual coupling between the antenna elements of the two interleaved arrays.

Other types of antenna elements can be used in array antennas. So-called "patch" antennas are generally planar, and in the context of an array antenna lie in the plane of the array, without significant projections above (in the radiating direction relative to) the plane of the array. Such patch antennas have the salient advantage of low wind loading, and are easy to protect with a planar radome.

In order to transmit or receive electromagnetic signal, an antenna element must respond to an electromagnetic field traveling toward or from the desired direction. In order to respond to the electromagnetic signal, the antenna must have a finite physical extent or "aperture" in the desired polarization in order to interact with the field being transduced. One of the salient advantages of an arrangement such as that of the Praba patent is that it has finite extent in two dimensions. A planar array of planar patch antenna elements, when viewed from a direction orthogonal to the plane of the array, has a physical extent which substantially equals the patch dimension for the polarization in question. Viewed from a location within the plane of the array, however, each patch antenna has substantially zero projected extent or dimension, at least in one polarization. Consequently, the ability of a planar array of planar or patch antennas to transceive in the direction of the plane may be limited, or in antenna terms it may have relatively low "gain". In addition to the problem of lack of projected dimension which results in low gain in the plane of the array, there is the problem that radiation to or from any one element of the array must pass by one or more adjacent antenna elements. These adjacent antenna elements tend to interact with so much field as may exist, which in turn tends to "block" the field to or from adjacent antenna elements. This interaction between mutually adjacent antenna elements of an array is termed "mutual coupling." One manifestation of mutual coupling is a tendency of the impedance of the antenna element to be dependent on the signal transduced by the adjacent (and sometimes semi-adjacent) elements. Mutual coupling often has adverse consequences in the overall operation of the array, and may be undesired.

It is desirable to be able to produce as much radiated power as possible in the transmitting mode of the antenna array in order to maximize the power aperture efficiency. The passage of electromagnetic signal through the radome results in heating of the radome. Since the radome may also be subject to substantial solar loading, it is desirable to reduce the radome temperature.

Improved or alternative antenna arrays and elements therefor are desired.

SUMMARY OF THE INVENTION

An antenna element according to an aspect of the invention comprises a generally planar ground plane and an electrically conductive first planar disk lying parallel with the ground plane and spaced therefrom by a first distance. The first planar disk defines a feed side facing the ground plane. An electrically conductive second planar disk lies parallel with the ground plane and is spaced therefrom by a second distance, greater than the first distance. The second planar disk is registered with the first planar disk, at least in that they are concentric. An elongated thermally conductive element is thermally coupled to a first location on the ground plane, extends perpendicular to the ground plane along a central axis, and makes thermal contact with the center of the first planar disk and with the center of the second planar disk. At least first and second feed conductors make contact with the feed side of the first planar disk at first and second feed locations lying on a first line extending through the central axis. This antenna element may be associated with a locally planar radome overlying and thermally coupled to the second planar disk and the thermally conductive element. In a preferred embodiment of this antenna element, the elongated thermally conductive element is electrically conductive, and additionally makes electrical contact with centers of the first and second disks and with the ground plane. In one manifestation, the first and second feed locations are equidistant from the central axis. In a preferred version, the antenna element further comprises at least a first wing supported by the ground plane, the first wing is oriented so that the central axis lies in a plane thereof which is orthogonal to the ground plane. The first wing lies outside of the projection, parallel with the central axis, of the second planar disk, and the plane of the first wing lies equidistant from the first and second feed locations. A more preferred version further comprises at least a second wing, which may also define a plane, supported by the ground plane. The plane of the second wing lies in the same plane as that of the first wing. The second wing lies outside of the projection, parallel with the central axis, of the second planar disk, and diametrically opposite to the first wing about the central axis. In a most preferred embodiment, both wings are metallic or dielectric, or the first wing is metallic and the second wing is dielectric. The dielectric of the wings is high-dielectric-constant material. The first wing may have a generally rectangular outline.

The first and second feed conductors of the antenna element according to an aspect of the invention may comprise lesser conductors of first and second unbalanced feed transmission lines, each defining a greater conductor. The greater conductors of the first and second unbalanced feed transmission lines make electrical contact with the ground plane at first and second feedthrough locations, which first and second feedthrough locations are located at or centered on projections, parallel with the central axis, onto the ground plane from the first and second feed locations, respectively. More particularly, the first and second feed conductors may comprise center conductors of first and second feed coaxial transmission lines, each defining an outer conductor. The outer conductors of the first and second feed coaxial transmission lines make electrical contact with the ground plane at first and second feedthrough locations. The first and second feedthrough locations are located at or centered on projections, parallel with the central axis, onto the ground plane from the first and second feed locations, respectively. Thus, the first and second feedthrough locations are locations at which the center conductors of the first and second coaxial transmission lines extend through the ground plane without making electrical contact with the ground plane.

Another embodiment of the antenna element, includes third and fourth feed conductors. The third and fourth feed conductors make contact with the feed side of the first planar disk at third and fourth feed locations lying on a second line extending through the central axis and perpendicular to the first line extending from the first feed location to the second feed location. Ideally, the first and second feed locations are equidistant from the central axis, and if there are first, second, third, and fourth feed locations, all are equidistant from the central axis.

According to certain aspects of the invention, antenna element comprises at least a first wing supported by the ground plane. The first wing is oriented so that the central axis lies in the plane thereof. The first wing lies outside of the projection, parallel with the central axis, of the second planar disk, and the plane of the first wing lies equidistant from the first, second, third, and fourth feed locations. Some embodiments may further comprising a locally planar radome overlying and thermally coupled to the second planar disk andor to the thermally conductive element.

An antenna element according to another aspect of the invention may further comprise third and fourth feed conductors, making contact with the feed side of the first planar disk at third and fourth feed locations lying on a second line extending through the central axis, the second line extending perpendicular to the first line which extends from the first feed location to the second feed location. In this aspect of the invention, the first and second feed conductors comprise center conductors of first and second coaxial transmission feed lines each defining an outer conductor. The outer conductors of which first and second coaxial transmission lines make electrical contact with the ground plane at first and second particular locations, respectively, which are projections, parallel with the central axis, onto the ground plane from the first and second feed locations, respectively. The third and fourth feed conductors comprise center conductors of third and fourth coaxial transmission feed lines, each defining an outer conductor, the outer conductors of which third and fourth coaxial transmission lines make electrical contact with the ground plane at third and fourth particular locations which are projections, parallel with the central axis, onto the ground plane from the third and fourth feed locations, respectively. The antenna according to this aspect of the invention may further comprise at least a first wing supported by the ground plane. The first wing may be generally planar. The first wing is oriented so that the central axis lies in the plane of the first wing. The first wing lies outside of the projection, parallel with the central axis, of the second planar disk. The first wing may be electrically conductive. The antenna according to this aspect of the invention may further include a second wing supported by the ground plane. The second wing may define a plane lying in the same plane as that of the first wing. The second wing lies outside of the projection, parallel with the central axis, of the second planar disk, and diametrically opposite, relative to the central axis, the first wing. When two wings are provided, both wings are metallic or dielectric, or the first wing is electrically conductive or metallic and the second wing is dielectric. The dielectric of the wings is high-dielectric-constant material. In one embodiment, the maximum projection of the first wing from the ground plane is no greater than the maximum projection of the second planar disk from the ground plane. The plane of the first wing may lie equidistant from the first and second feed locations, or from the first, second, third, and fourth feed locations, if provided. If four feed locations are provided, the plane of the first wing may lie equidistant from the first, second, third, and fourth feed locations.

An antenna element according to another aspect of the invention comprises a generally planar ground plane, and an electrically conductive first planar disk lying parallel with the ground plane and spaced therefrom by a first distance. The first planar disk defines a feed side facing the ground plane and is centered on a central axis of the antenna element. An electrically conductive second planar disk (18) lies parallel with the ground plane and is spaced therefrom by a second distance, greater than the first distance. The second planar disk is centered on the central axis. The first and second planar disks may be of different sizes. At least first and second feed conductors make contact with the feed side of the first planar disk at first and second feed locations lying on a first line extending through the central axis. At least a first wing is supported by the ground plane. The first wing may be planar, and oriented so that the central axis lies in the plane thereof. In one embodiment of this aspect of the invention, the first wing is electrically conductive or includes a metallic component. The first and second feed locations may be equidistant from the central axis. The first wing may lie outside of the projection, parallel with the central axis, of the second planar disk, and the plane of the first wing may lie equidistant from the first and second feed locations. The first wing may have a generally rectangular outline. In one version of this aspect, the antenna element further comprises third and fourth feed conductors. The third and fourth feed conductors make contact with the feed side of the first planar disk at third and fourth feed locations, respectively, lying on a second line extending through the central axis and perpendicular to the first line extending from the first feed location to the second feed location. The first feed location and the second feed location are preferably equidistant from the central axis. Most preferably, the first, second, third, and fourth feed locations are equidistant from the central axis. The plane of the first wing preferably lies equidistant from the first, second, third, and fourth feed locations. The maximum projection of the first wing from the ground plane is no greater than the maximum projection of the second planar disk from the ground plane.

An antenna array according to an aspect of the invention comprises plural elemental antennas. Each of the elemental antennas includes a plurality (two illustrated) of stacked, concentric, generally planar antenna elements. Each of the elemental antennas includes a first wing generally defining a plane orthogonal to the plane (or planes) of the planar antenna elements and also includes a second wing generally defining a plane orthogonal to the plane of the planar antenna elements. The first and second wings are coplanar, with the axis of concentricity of the planar antenna elements lying in the plane of the first and second wings. The plurality of elemental antennas is arrayed in a planar manner, with no wing of any elemental antenna lying directly between the axes of concentricity of adjacent ones of the elemental antennas.

An antenna array according to another aspect of the invention comprises a plurality of elemental antennas arrayed in a plane. Each of the elemental antennas includes stacked, concentric, generally planar antenna elements. Each of the elemental antennas includes a first wing generally defining a plane orthogonal to the planes of the antenna elements and a second wing also generally defining a plane orthogonal to the planes of the antenna elements. The first and second wings are coplanar, with the axis of concentricity lying in the common plane of the first and second wings. The arraying of the plurality of elemental antennas is such that the wings of the elemental antennas lie at least partially between adjacent ones of the antenna elements, but not directly between the axes of concentricity thereof. When two wings are provided, both wings are metallic or dielectric, or the first wing is electrically conductive or metallic and the second wing is dielectric. The dielectric of the wings is high-dielectric-constant material.

In an antenna array or subarray according to an aspect of the invention, the antenna array or subarray comprises a plurality of elemental antennas. Each of the elemental antennas comprises:

(a) a generally planar ground plane;

(b) an electrically conductive first planar disk lying parallel with the ground plane and spaced therefrom by a first distance, the first planar disk defining a feed side facing the ground plane;

(c) an electrically conductive second planar disk lying parallel with the ground plane and spaced therefrom by a second distance, greater than the first distance, the second planar disk being registered with the first planar disk;

(d) an elongated thermally conductive element thermally coupled to a first location on the ground plane and extending perpendicular to the ground plane along a central axis, and making thermal contact with the center of the first planar disk and with the center of the second planar disk; and (e) at least first and second feed conductors making contact with the feed side of the first planar disk at first and second feed locations lying on a first line extending through the central axis.

The generally planar ground plane of the elemental antennas is electrically continuous across the array or subarray. The first and second feed conductors of each of the elemental antennas of the array or subarray are fed with the same phase progression as other antenna elements of the array or subarray. In one embodiment of such an array or subarray, the elongated thermally conductive element is additionally electrically conductive, and is electrically and thermally coupled to a first location on the ground plane and makes electrical and thermal contact with the center of the first planar disk and with the center of the second planar disk. An embodiment may further comprise a radome extending over the second planar disk of each elemental antenna of the array or subarray, which radome is in thermal communication with the second planar disk and the thermal element of each antenna element of the array or subarray. In one version, each elemental antenna of the antenna array or subarray further comprises at least a first wing supported by the ground plane, which first wing is oriented so that the central axis lies in a plane thereof. The first wing may lie outside of the projection, parallel with the central axis, of the second planar disk. The plane of the first wing may lie equidistant from the first and second feed locations. A second wing may be included. When two wings are provided, both wings are metallic or dielectric, or the first wing is electrically conductive or metallic and the second wing is dielectric. The dielectric of the wings is high-dielectric-constant material.

DESCRIPTION OF THE INVENTION

Figure 1:
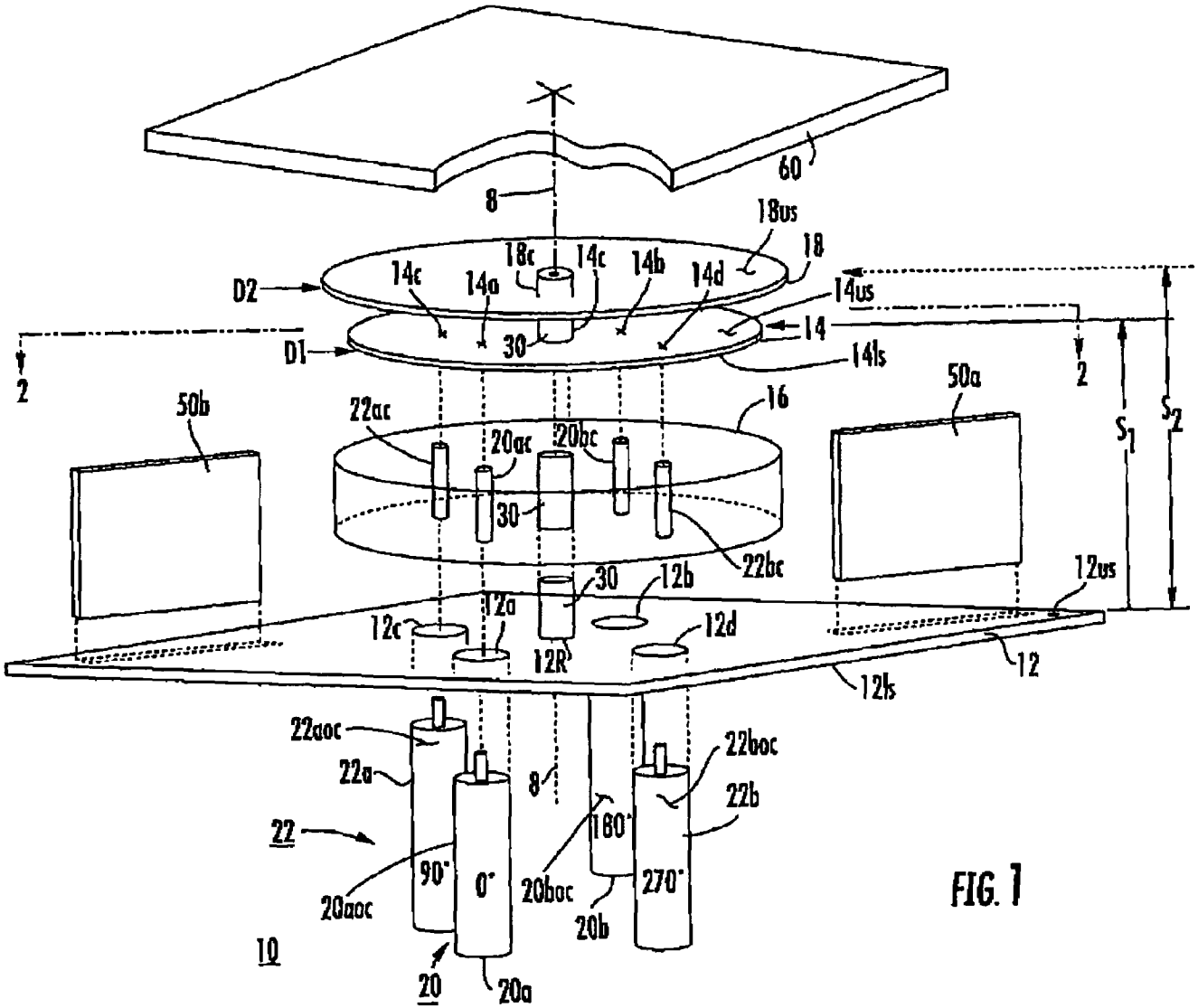
FIG. 1 is a simplified notional representation, partially exploded to reveal details, of an antenna element according to an aspect of the invention.

In FIG. 1, an antenna element 10 for use in an array includes a ground plane 12 having an upper surface 12*us*. A first electrically conductive disk 14 with diameter D1 is fixedly mounted at a distance S1 above the upper surface 12*us* of ground plane 12, centered on a central axis 8. As illustrated in FIG. 1, first disk 14 may be supported by a dielectric disk 16, which in turn is supported on upper surface 12*us* of ground plane 12. That side of ground plane 12 on which disk 14 is found is the "radiating" side of the antenna, in that electromagnetic transduction occurs in the half-plane above ground plane 12. FIG. 1 also shows a second conductive disk 18 having a diameter D2 which is mounted concentrically and parallel with disk 14, and is spaced therefrom at a location more remote from ground plane 12. More particularly, disk 18 is at a distance of S2 from the ground plane 12, where, distance S2 is greater than distance S1. As illustrated in FIG. 1, diameter D1 is less than diameter D2. Stacked disk antennas are known, as exemplified by the articles *A Dual-Frequency Stacked Circular-Disc Antenna*, published by Long et al. at pages 270-273 of IEEE Transactions on Antennas and Propagation, Vol. AP-27, No. 2, March 1979; *A Lightweight, C-Band, Dual Circularly Polarized Microstrip Antenna for Satellite Applications*, published by Sichan et al. at pages 909-912 of the 1989 IEEE article CH2654-2/89/0000-0909; *Input Impedance of a Probe-Fed Stacked Circular Microstrip Antenna*, published by Tulintseff et al. at pp 381-390 of the IEEE Transactions on Antennas and Propagation, Vol. 39, NO. 3, March 1991; *Low-Profile, Broadband, Wide-Scan, Circular Polarized Phased Array Radiator*, published by Wang et al. at pages 1150-1153 of the 1996 IEEE publication 0-7803-3216-4/96; and *Low-Profile, Integrated Radiator Tiles for Wideband, Circular-Polarized Phased Array Applications*, published by Wang et al. at pages 1000-1003 of the 1998 IEEE article 0-7803-4478-2/98.

The description herein includes relative placement or orientation words such as "top," "bottom," "up," "down," "lower," "upper," "horizontal," "vertical," "above," "below," as well as derivative terms such as "horizontally," "downwardly," and the like. These and other terms should be understood as to refer to the orientation or position then being described, or illustrated in the drawing(s), and not to the orientation or position of the actual element(s) being described or illustrated. These terms are used for convenience in description and understanding, and do not require that the apparatus be constructed or operated in the described position or orientation. Similarly, terms concerning mechanical attachments, couplings, and the like, such as "connected," "attached," "mounted," refer to relationships in which structures are secured or attached to one another either directly or indirectly through intervening structures, as well as both movable and rigid attachments or relationships, unless expressly described otherwise.

The antenna 12 of FIG. 1 can be fed so as to transduce linear-only polarization or so as to transduce circular polarization. To transduce linear polarization, the lower surface of disk 14 is fed at two locations, diametrically opposite to each other relative to central axis 8, with signals which are out-of-phase. Such out-of-phase signals may be viewed as being represented by 0° and 180° phases. Thus, the signal feed for linear polarization may be viewed as applying relative 0° and 180° signals at locations 14*a* and 14*b* of disk 14. As an alternative, the 0° and 180° signals may be applied at locations 14*c* and 14*d*. The linear feed for antenna 10 of FIG. 1 is implemented by a set 20 of coaxial transmission lines 20*a* and 20*b*. The outer conductor 20*aoc* of coaxial transmission line 20*a* is affixed to the periphery of an aperture 12*a* extending through the ground plane 12. Aperture 12*a* is centered on the projection, parallel with central axis 8, of feed point or location 14*a* onto ground plane 12. The outer conductor 20*boc* of coaxial transmission line 20*b* is affixed to the periphery of an aperture 12*b* extending through the ground plane 12. Aperture 12*b* is centered on the projection, parallel with central axis 8, of feed point or location 14*b* onto ground plane 12. The center conductor 20*ac* of coaxial transmission line 20*a* extends upward from aperture 12*a*, through dielectric material 16, and makes contact with the underside (not visible in FIG. 1) of lower disk 14 at feed location 14*a*. Similarly, the center conductor 20*bc* of coaxial transmission line 20*b* extends upward from aperture 12*b*, through dielectric material 16, and makes contact with the underside (not visible in FIG. 1) of lower disk 14 at feed location 14*b*. Those skilled in the art know how coaxial transmission lines 20*a* and 20*b* may be fed with relative 0° and 180° signals so as to effectuate the desired linear excitation.

Another linear feed for antenna 10 of FIG. 1 can be implemented by a set 22 of coaxial transmission lines 22*a* and 22*b*. The outer conductor 22*aoc* of coaxial transmission line 22*a* is affixed to the periphery of an aperture 12*c* extending through the ground plane 12, which aperture is centered on a projection of feed location 14*c*, parallel with central axis 8, onto ground plane 12. The outer conductor of coaxial transmission line 22*b* is affixed to the periphery of an aperture 12*d* extending through the ground plane 12, which aperture is centered on a projection of feed location 14*d*, parallel with central axis 8, onto ground plane 12. The center conductor 22*ac* of coaxial transmission line 22*a* extends upward from aperture 12*a*, through dielectric material 16, and makes contact with the underside (not visible in FIG. 1) of lower disk 14 at location 14*c*. Similarly, the center conductor 22*bc* of coaxial transmission line 22*b* extends upward from aperture 12*d*, through dielectric material 16, and makes contact with the underside (not visible in FIG. 1) of lower disk 14 at location 14*d*. Those skilled in the art know how coaxial transmission lines 22*a* and 22*b* may be fed with relative 0° and 180° signals so as to effectuate an alternate linear excitation, as described, for example, in U.S. Pat. No. 5,880,694, issued Mar. 9, 1999 in the name of Wang et al.

It is also possible to excite the antenna 10 of FIG. 1 with quadrature-phase signals to achieve transduction of circularly polarized (or at least elliptically polarized) signals. This is accomplished by feeding disk 14 with signals in a phase progression related to the feed location. For example, if coaxial transmission lines 20*a*, 22*a*, 20*b*, and 22*b* are fed with relative phases of 0°, 90°, 180°, and 270°, respectively, the desired polarization response is achieved. Generation of such phase progressing feeds is well known and is not a part of the invention.

According to an aspect of the invention, an elongated thermally and electrically conductive element or rod 30 is thermally affixed to ground plane 12 concentric with central axis 8. Rod 30 extends through dielectric support element 16, and makes thermal and electrical contact with the underside of second conductive disk 18. Rod 30 also makes thermal and electrical contact with first conductive disk 14, either peripherally where rod 30 passes through disk 14, or by being separated into two parts, one of which extends from ground plane 12 to the underside of disk 14, and another of which extends from the upper side of disk 14 to disk 18.

A radome designated 60 is illustrated as overlying second conductive disk 18 in FIG. 1. As mentioned, heating of the radome by electromagnetic radiation, in conjunction with sun loading, can raise the temperature thereof sufficiently to cause degradation. The purpose of thermal conducting rod 30 is to aid in removal of heat from the radome 60. For this purpose, the "distal" end of rod 30, relative to the proximal end affixed to the ground plane, may extend slightly above the plane of second conductive disk 18 to make contact with radome 60, or the rod 30 may contact only the conductive disk 18. In that case in which the rod 30 extends only to conductive disk 18, heat can be conducted to the rod 30 by way of thermal conduction between the radome 60 and the disk 18. The heat coupled to the distal end of rod 30 is conducted downward through rod 30, and into ground plane 12. Within ground plane 12, the heat can spread in a transverse direction (in the plane of the ground plane 12) and ultimately to heat sinks associated with the structure lying under the ground plane 12.

Figure 2:
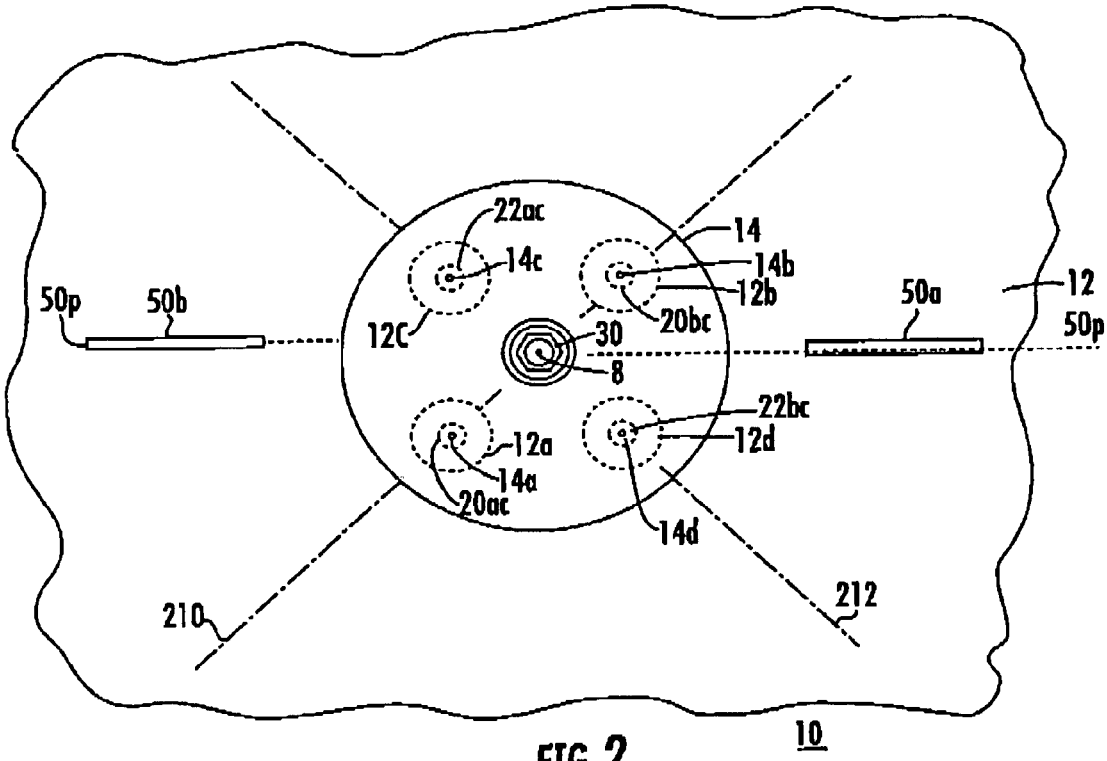
FIG. 2 is a plan view, taken at section lines 2-2, of the structure of FIG. 1.

FIG. 2 is a cross-sectional representation of the structure of FIG. 1 looking in direction 2-2. In FIG. 2, element corresponding to those of FIG. 1 are designated by like reference numerals. In FIG. 2, the ground-plane feedthroughs 12*a*, 12*b*, 12*c*, and 12*d* are viewed through disk 14, so are illustrated by dash lines. The thermally and electrically conductive rod 30 is coaxial with central axis 8. As illustrated in FIG. 2, the wings 50*a* and 50*b* lie in a common plane 50P, and plane 50P includes central axis 8. That is, central axis 8 lies in the plane 50P of the wings 50*a* and 50*b*. It should be noted that the overall vertical dimension or height of the antenna element 10 of FIG. 1 is small, so the wings 50*a* and 50*b* also have a small vertical height. Depending upon the transverse dimension of the wings, they may or may not have a planar appearance. For descriptive purposes, the wings 50*a* and 50*b* are deemed to be planar or to define a plane. Feed points 14*a* and 14*b* of FIG. 2 lie on a line 210 extending through central axis 8. Feed points 14*c* and 14*d* line on a line 212 extending through central axis 8. Also, plane 50P passes equidistantly between feed points 14*a*, 14*b*, 14*c*, and 14*d*. That is, a line extending from line 210 at feed location 14*a* perpendicular to plane 50P is of the same length as a line extending from line 210 at feed location 14*b* perpendicular to plane 50P. Similarly, a line extending from line 212 at feed location 14*c* perpendicular to plane 50P is of the same length as a line extending from line 212 at feed location 14*d* perpendicular to plane 50P.

According to an aspect of the invention, when two wings are provided, both wings are metallic or dielectric, or the first wing is electrically conductive or metallic and the second wing is dielectric. The dielectric of the wing or wings is high-dielectric-constant material. Such wings tend to reduce the flow of surface waves along an array of elements at large elevation scan angles, thereby tending to increase the bandwidth and scan ability of the antenna array.

Figure 3:
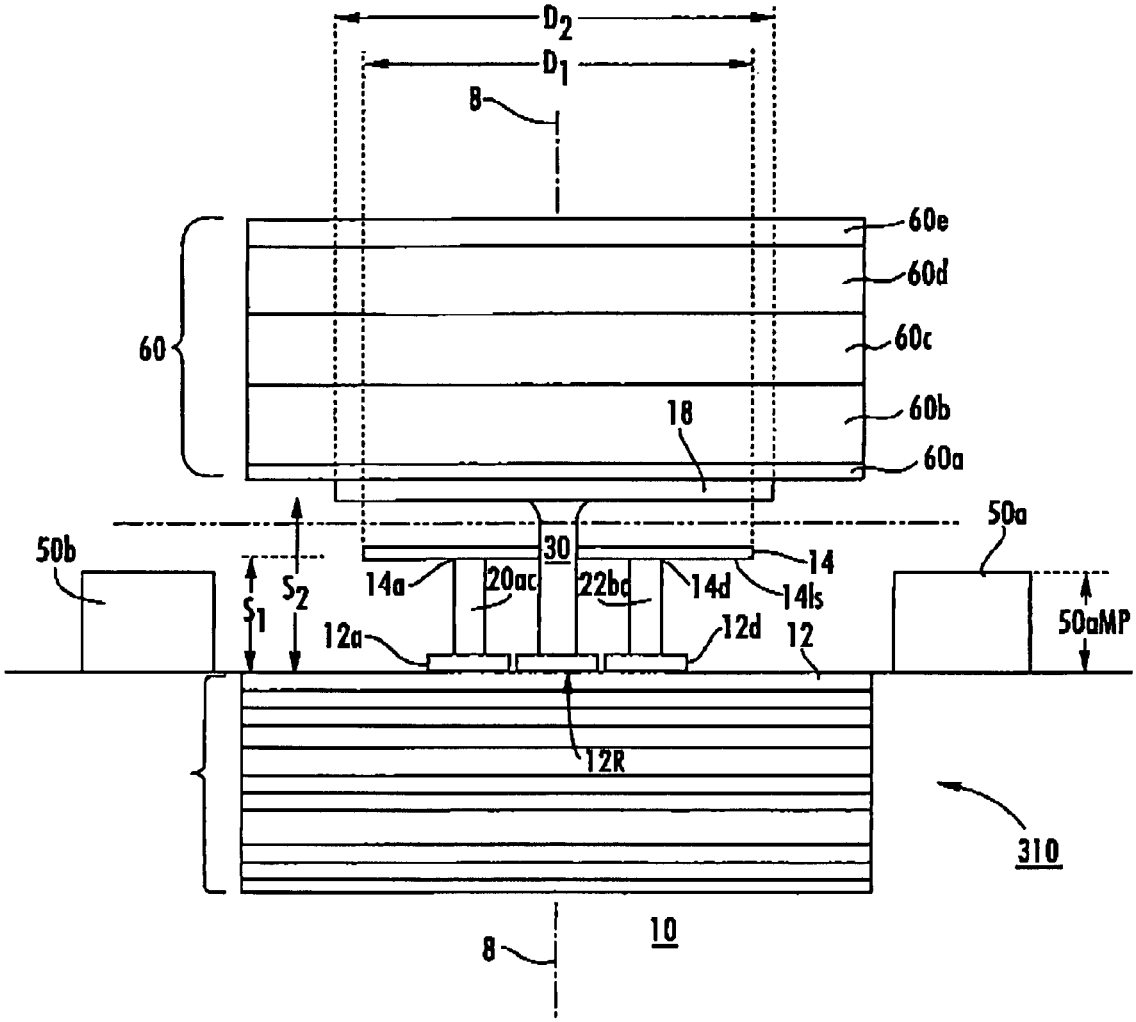
FIG. 3 is a cross-sectional view of a structure similar to that of FIG. 2, with an unbalanced planar feed structure rather than an unbalanced coaxial feed structure.

FIG. 3 is a simplified elevation view of a structure similar to that of FIGS. 1 and 2, differing in that the feed structure includes a plurality of planar layers. In FIG. 3, the radome 60 is illustrated as being made up of a plurality of layers 60*a*, 60*b*, 60*c*, 60*d*, and 60*e*, which may include layers resistant to ultraviolet radiation, mechanical abrasion, water, and salts, and having various dielectric constants to aid in reducing reflections.

Figure 4A:
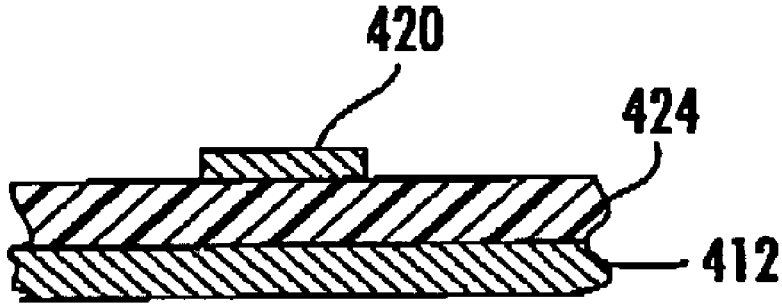
FIG. 4*a* is a simplified representation of an unbalanced microstrip feed structure.
Figure 4B:
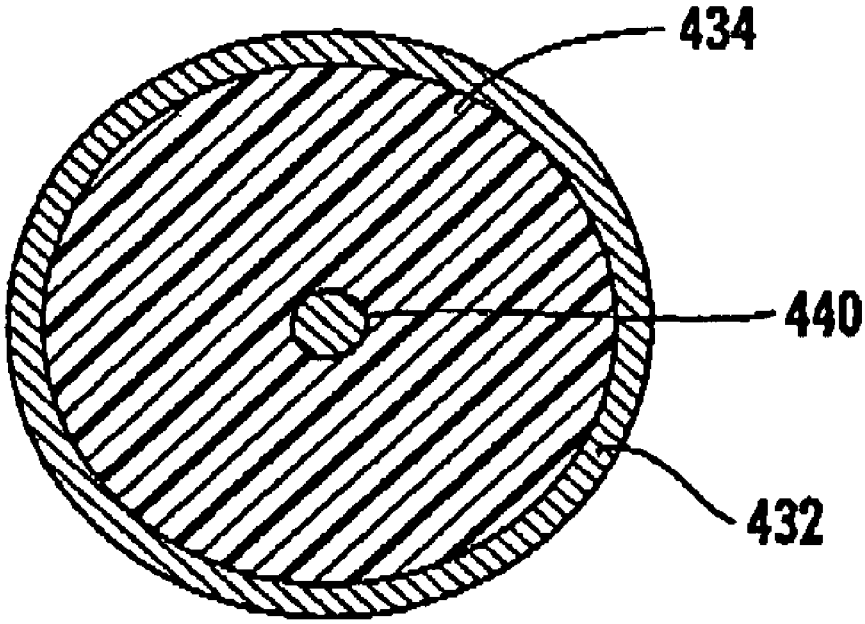
FIG. 4*b* represents its topological equivalent coaxial feed structure.

In FIG. 3, a layered structure 310 lies under ground plane 12. This layered structure can be used with an array of antenna elements such as the single antenna element illustrated, to accommodate, and provide interconnections between the phase shifters, amplifiers, beamformer elements, if used in the array, and the various feed points of the antenna elements. These layered structures may provide phase progressions from element to element of the array, as known in the art. Such accommodation and interconnections by layers are well known in the art. In this regard, it may be advantageous to note that signal transmission in such layered structures is generally by means of microstrip or stripline rather than by coaxial transmission lines. The differences between microstrip and coaxial transmission lines are illustrated in the cross-sections of FIGS. 4*a* and 4*b*. FIG. 4*a* illustrates a microstrip transmission line including a planar ground 412. A strip conductor 420 lies spaced above ground 412 by a planar dielectric material 424. Such structures are referred to as being "unbalanced" transmission lines since the two conductors are not of the same extent and do not have a plane of symmetry. That is, the strip conductor 420 is lesser than the ground conductor 412. Other unbalanced transmission lines known to be topological transformations of microstrip are the coaxial transmission line, seen in cross-section in FIG. 4*b*. In FIG. 4*b*, the lesser or center conductor 440 lies centered by a dielectric material 434 within a circular conductor 432. "Stripline" transmission lines (not illustrated) are similar to the microstrip of FIG. 4*a*, but include a further ground plane lying above the strip conductor.

Figure 5:
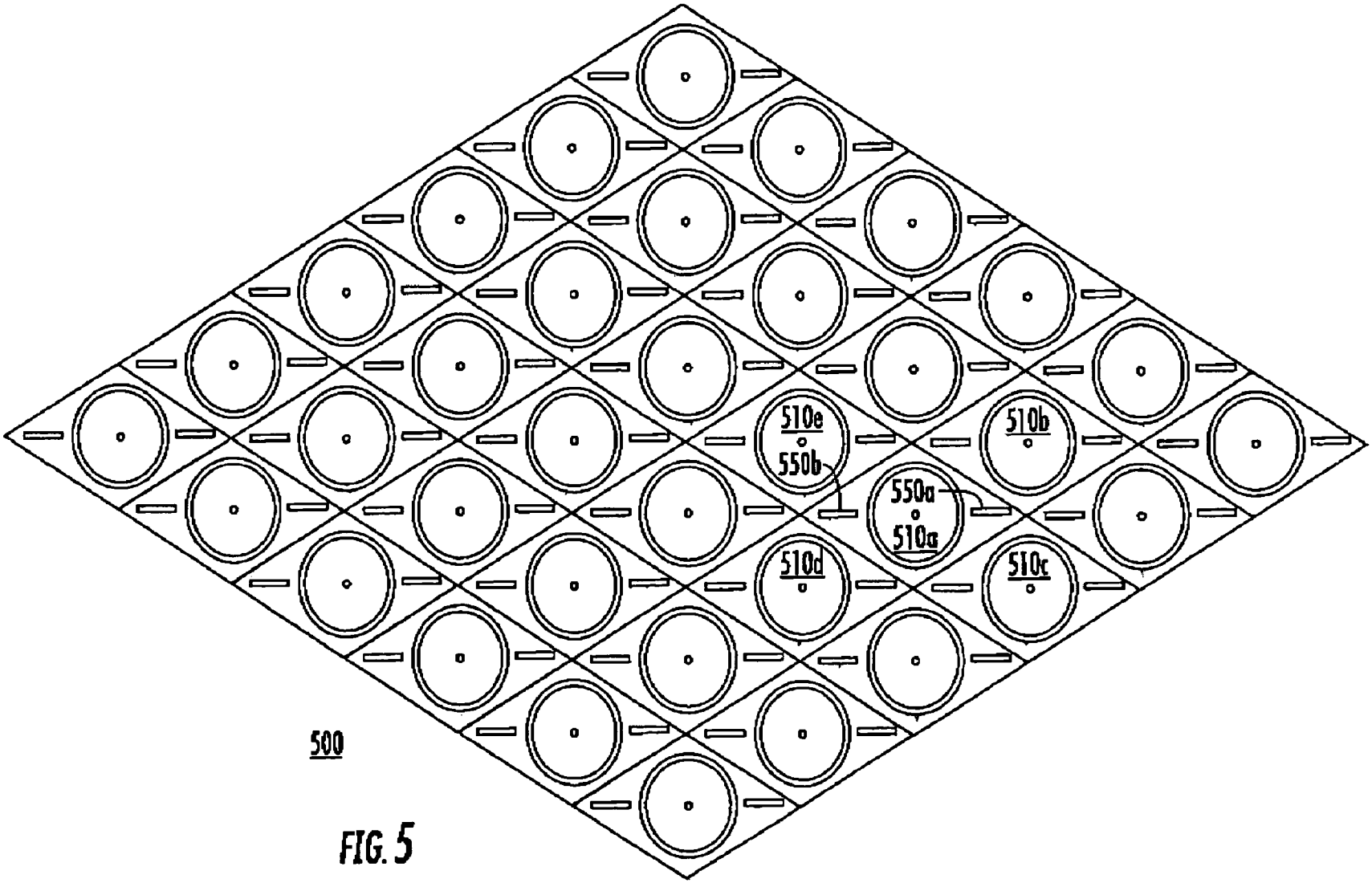
FIG. 5 is a simplified plan view of a six-by-six-element array of elemental antennas, each similar to those described in conjunction with FIGS. 1, 2, and 3.

FIG. 5 illustrates a "tile" or subarray of plural elemental antennas, each similar to that of FIG. 1, 2, or 3, arrayed in a staggered fashion to define an outline which is readily interconnected with adjacent tiles similarly formed. Thus, the term "elemental antenna" is applied to the antenna element 10 of FIG. 1 when discussed in the context of an array. In FIG. 5, a six-by-six array 500 shows an overall "diamond" shape corresponding to the shape of the individual elemental antennas. The ground plane of the arrangement of FIG. 5 bears markings delineating the extent of each individual tile, but these lines are only representations, as the ground plane is preferably continuous across the subarray. As illustrated, each elemental antenna has its wings in-line with the wings of antenna elements on a diagonal line across the array, and all such lines on which the wings lie are mutually parallel. Each wing in the array arrangement of FIG. 5 of one elemental antenna lies partially between adjacent ones of the elemental antennas. That is, each wing does not lie directly between adjacent ones of the array elements, but each wing lies partially between adjacent ones of the elemental antennas of the array. For example, elemental antenna 510*a* of array 500 of FIG. 5 has two associated wings, namely wings 550*a* and 550*b*. Elemental antennas immediately adjacent to elemental antenna, 510*a* include elemental antennas 510*b*, 510*c*, 510*d*, and 510*e*. Wing 550*a* of elemental antenna 510*a* does not lie directly between adjacent elemental antennas 510*b* and 510*c*, just as wing 550*b* does not lie directly between the centers of adjacent elemental antennas 510*d* and 510*d*.

Figure 6:
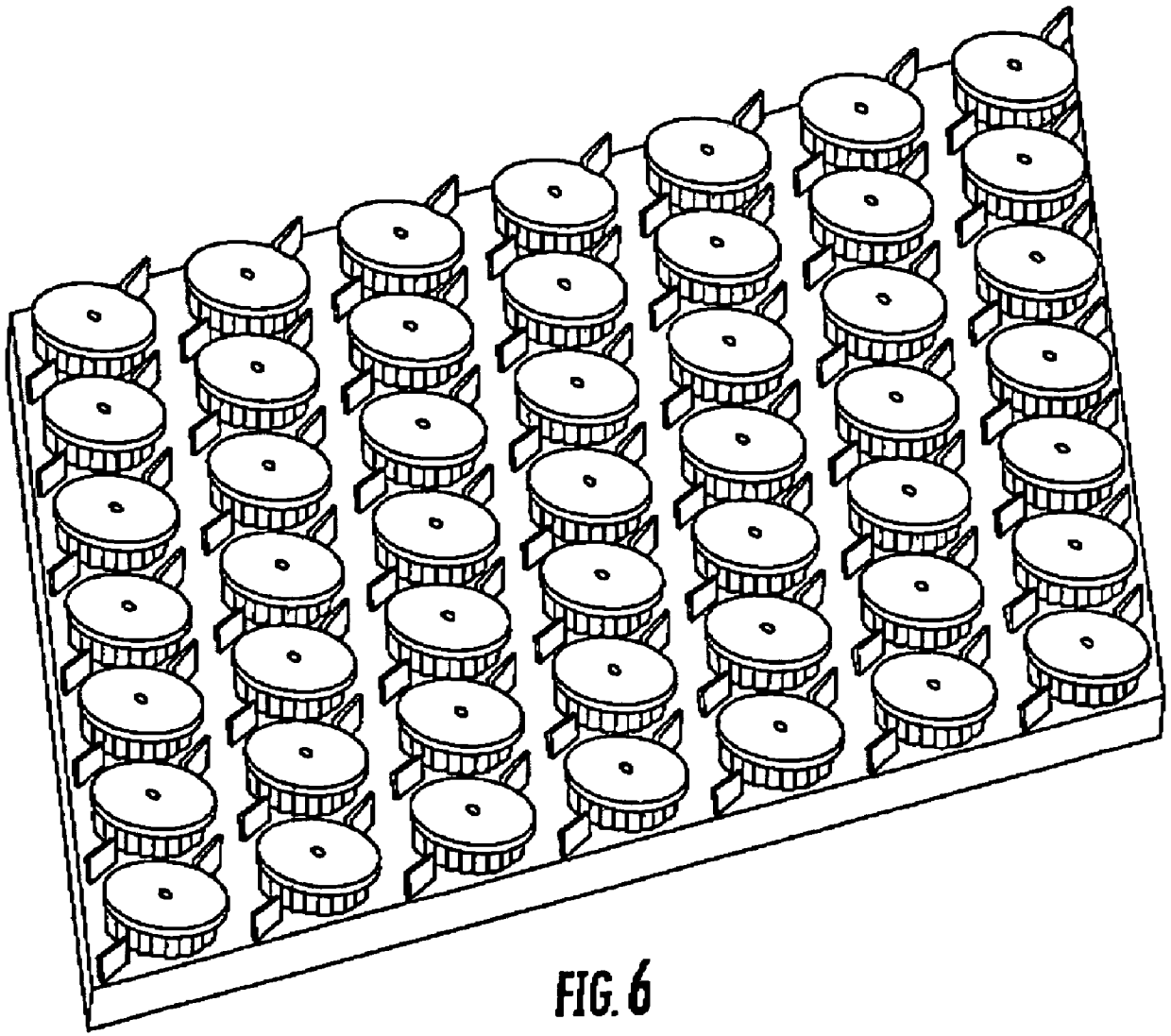
FIG. 6 is a simplified perspective or isometric view of an array larger than that of FIG. 5.

When a plurality of tiles such as those of FIG. 5 are interconnected to form an array larger than a single tile, a structure can be formed, a part of which may be similar to FIG. 6. In FIG. 6, a seven-by-seven array of array elements is defined, with the wings thereof lying in a plurality of parallel planes extending at 450 to the direction of the array. The wings of antenna elements of different subarrays maintain their alignment with the wings of adjacent elements, regardless of which subarray they populate. It has been found that the use of wings such as those described, in the context of an array, tends to reduce mutual coupling between mutually adjacent antenna elements. The reduction in mutual coupling allows the array using such elements to be scanned over a greater solid angle than a corresponding array without the wings.

It has been discovered that if both wings of each elemental antenna of an array are made from electrically conductive material, some resonances in the form of standing waves can occur at large elevation scan angles. The standing waves support the excitation of the even mode in the feed circuits and create almost full reflection. These surface wave resonances can be suppressed by making one of the wings of each pair, say wing 550*a* of FIG. 5, of metal, and making the other wing 550*b* of dielectric material, or both wings 550*a* and 550*b* of dielectric. It has also been discovered that the presence of an electrically conductive thermal rod or element 30, rather than a nonconductive element, also tends to provide additional suppression of even mode resonances. Differences of as much as 2 dB in scan loss have been noted at high elevation angles from these effects. Consequently, the preferred embodiments of arrays according to an aspect of the invention use electrically conductive thermal conduction elements and conductive/nonconductive wing pairs.

Thus, an antenna element (10) according to an aspect of the invention comprises a generally planar ground plane (12) and an electrically conductive first planar disk (14) lying parallel with the ground plane (12) and spaced therefrom by a first distance (S1). The first planar disk (14) defines a feed side (14*ls*) facing the ground plane (12). An electrically conductive second planar disk (18) lies parallel with the ground plane (12) and is spaced therefrom by a second distance (S2), greater than the first distance (S1). The second planar disk (18) is registered with the first planar disk (14), at least in that they are concentric. An elongated thermally and electrically conductive element (30) is thermally and electrically coupled to a first location (12R) on the ground plane (12), extends perpendicular to the ground plane (12) along a central axis (8), and makes thermal and electrical contact with the center of the first planar disk (14) and with the center of the second planar disk (18). At least first (20*ac*) and second (20*bc*) feed conductors make contact with the feed side (14*ls*) of the first planar disk (14) at first (14*a*) and second (14*b*) feed locations lying on a first line (210) extending through the central axis (8). This antenna element (10) may be associated with a locally planar radome (60) overlying and thermally coupled to the second planar disk (18) and the thermally conductive element (30). In a preferred embodiment of this antenna element (10), the elongated thermally conductive element (30) is electrically conductive, and additionally makes electrical contact with centers of the first (14) and second (18) disks and with the ground plane (12). In one manifestation, the first (14*a*) and second (14*b*) feed locations are equidistant from the central axis (8). In a preferred version, the antenna element (10 further comprises at least a first wing (50*a*) supported by the ground plane (12), the first wing (50*a*) being oriented so that the central axis (8) lies in a plane (50*p*) thereof which is orthogonal to the ground plane (12). The first wing (50*a*) lies outside of the projection, parallel with the central axis (8), of the second planar disk (18), and the plane (50P) of the first wing (50*a*) lies equidistant from the first (14*a*) and second (14*b*) feed locations. A more preferred version further comprises at least a second wing (50*b*), which may also define a plane (50P), supported by the ground plane (12). The plane (50P) of the second wing (50*b*) lies in the same plane as that of the first wing (50*a*). The second wing (50*b*) lies outside of the projection, parallel with the central axis (8), of the second planar disk (18), and diametrically opposite to the first wing (50*a*) about the central axis (8). In a most preferred embodiment, both wings are metallic or dielectric, or the first wing is metallic and the second wing is dielectric. The dielectric of the wings is high-dielectric-constant material. The first wing may have a generally rectangular outline.

The first (20*ac*) and second (20*bc*) feed conductors of the antenna element (10) according to an aspect of the invention may comprise lesser conductors of first (20*a*) and second (20*b*) unbalanced feed transmission lines, each defining a greater (outer) conductor. The greater conductors of the first (20*a*) and second (20*b*) unbalanced feed transmission lines make electrical contact with the ground plane (12) at first (12*a*) and second (12*b*) feedthrough locations, which first and second feedthrough locations are located at or centered on projections, parallel with the central axis (8), onto the ground plane (12) from the first (14*a*) and second (14*b*) feed locations, respectively. More particularly, the first and second feed conductors may comprise center conductors of first (20*a*) and second (20*b*) feed coaxial transmission lines, each defining an outer conductor (20*aoc*; 20*boc*). The outer conductors (20*aoc*; 20*boc*) of the first (20*a*) and second (20*b*) feed coaxial transmission lines make electrical contact with the ground plane (12) at first (12*a*) and (12*b*) second feedthrough locations. The first (12*a*) and second (12*b*) feedthrough locations are located at or centered on projections, parallel with the central axis (8), onto the ground plane (12) from the first (14*a*) and second (14*b*) feed locations, respectively. Thus, the first (12*a*) and second (12*b*) feedthrough locations are locations at which the center conductors (20*ac*; 20*bc*) of the first (20*a*) and second (20*b*) coaxial transmission lines extend through the ground plane (12) without making electrical contact with the ground plane.

Another embodiment of the antenna element (10), includes third (22*ac*) and fourth (22*bc*) feed conductors. The third (22*ac*) and fourth (22*bc*) feed conductors make contact with the feed side (14*ls*) of the first planar disk (14) at third (14*c*) and fourth (14*d*) feed locations lying on a second line (212) extending through the central axis (8) and perpendicular to the first line (210) extending from the first feed location (14*a*) to the second (14*b*) feed location. Ideally, the first and second feed locations are equidistant from the central axis (8), and if there are first (14*a*), second (14*b*), third (14*c*), and fourth (14*d*) feed locations, all are equidistant from the central axis (8).

According to certain aspects of the invention, antenna element (10) comprises at least a first wing (50*a*) supported by the ground plane (12). The first wing (50*a*) is oriented so that the central axis (8) lies in the plane thereof. The first wing (50*a*) lies outside of the projection, parallel with the central axis (8), of the second planar disk (18), and the plane of the first wing (50*a*) lies equidistant from the first, second, third, and fourth feed locations. Some embodiments may further comprising a locally planar radome (60) overlying and thermally coupled to the second planar disk (18) andor to the thermally conductive element (30).

An antenna element according to another aspect of the invention may further comprise third (22*ac*) and fourth (22*bc*) feed conductors, making contact with the feed side (14*ls*) of the first planar disk (14) at third (14*c*) and fourth (14*d*) feed locations lying on a second line (212) extending through the central axis (8), the second line (212) extending perpendicular to the first line (210) which extends from the first feed location (14*a*) to the second feed location (14*b*). In this aspect of the invention, the first (20*ac*) and second (20*bc*) feed conductors comprise center conductors of first (20*a*) and second (20*b*) coaxial transmission feed lines each defining an outer conductor (20*aoc*, 20*boc*). The outer conductors (20*aoc*, 20*boc*) of which first (20*a*) and second (20*b*) coaxial transmission lines make electrical contact with the ground plane (12) at first (12*a*) and second (12*b*) particular locations, respectively, which are projections, parallel with the central axis (8), onto the ground plane (12) from the first (14*a*) and second (14*b*) feed locations, respectively. The third (22*ac*) and fourth (22*bc*) feed conductors comprise center conductors of third (22*a*) and fourth (22*bc*) coaxial transmission feed lines, each defining an outer conductor (22*aoc*, 22*boc*), the outer conductors (22*aoc*, 22*boc*) of which third (22*a*) and fourth coaxial (22*b*) transmission lines make electrical contact with the ground plane (12) at third (12*c*) and fourth (12*d*) particular locations which are projections, parallel with the central axis (8), onto the ground plane (12) from the third (14*c*) and fourth (14*d*) feed locations, respectively. The antenna according to this aspect of the invention may further comprise at least a first wing (50*a*) supported by the ground plane (12). The first wing (50*a*) may be generally planar. The first wing (50*a*) is oriented so that the central axis (8) lies in the plane of the first wing (50*a*). The first wing (50*a*) lies outside of the projection, parallel with the central axis (8), of the second planar disk (18). The first wing (50*a*) may be electrically conductive. The antenna according to this aspect of the invention may further include a second wing (50*b*) supported by the ground plane (12). The second wing (50*b*) may define a plane lying in the same plane as that of the first wing (50*a*). The second wing (50*b*) lies outside of the projection, parallel with the central axis (8), of the second planar disk (18), and diametrically opposite, relative to the central axis (8), the first wing (50*a*). In a most preferred embodiment, both wings are metallic or dielectric, or the first wing is metallic and the second wing is dielectric. The dielectric of the wings is high-dielectric-constant material. The first wing may have a generally rectangular outline. In one embodiment, the maximum projection of the first wing (50*a*) from the ground plane (12) is no greater than the maximum projection of the second planar disk (18) from the ground plane (12). The plane of the first wing (50*a*) may lie equidistant from the first (14*a*) and second (14*b*) feed locations, or from the first (14*a*), second (14*b*), third (14*c*) and fourth (14*d*) feed locations, if provided. If four feed locations are provided, the plane of the first wing (50*a*) may lie equidistant from the first (14*a*), second (14*b*), third (14*c*), and fourth (14*d*) feed locations.

An antenna element according to another aspect of the invention comprises generally planar ground plane (12), and an electrically conductive first planar disk (14) lying parallel with the ground plane (12) and spaced therefrom by a first distance (S1). The first planar disk (14) defines a feed side (14*ls*) facing the ground plane (12) and is centered on a central axis (8) of the antenna element. An electrically conductive second planar disk (18) lies parallel with the ground plane (12) and spaced therefrom by a second distance (S2), greater than the first distance (S1). The second planar disk (18) is centered on the central axis (8). The first and second planar disks may be of different sizes. At least first (20*ac*) and second (20*bc*) feed conductors make contact with the feed side (14*ls*) of the first planar disk (14) at first (14*a*) and second (14*b*) feed locations lying on a first line (210) extending through the central axis (8). At least a first wing (50*a*) is supported by the ground plane (12). The first wing (50*a*) may be planar, and oriented so that the central axis (8) lies in the plane thereof. In one embodiment of this aspect of the invention, the first wing (50*a*) is electrically conductive or includes a metallic component. The first (14*a*) and second (14*b*) feed locations may be equidistant from the central axis (8). The first wing (50*a*) may lie outside of the projection, parallel with the central axis (8), of the second planar disk (18), and the plane of the first wing (50*a*) may lie equidistant from the first (14*a*) and second (14*b*) feed locations. The first wing (50*a*) may have a generally rectangular outline. In one version of this aspect, the antenna element further comprises third (22*ac*) and fourth (22*bc*) feed conductors. The third (22*ac*) and fourth (22*bc*) feed conductors make contact with the feed side (14*ls*) of the first planar disk (14) at third (14*c*) and fourth (14*d*) feed locations lying on a second line (212) extending through the central axis (8) and perpendicular to the first line (210) extending from the first feed (14*a*) location to the second (14*b*) feed location. The first feed (14*a*) location and the second (14*b*) feed location are preferably equidistant from the central axis (8). Most preferably, the first (14*a*), second (14*b*), third (14*c*), and fourth (14*d*) feed locations are equidistant from the central axis (8). The plane of the first wing (50*a*) preferably lies equidistant from the first, second, third, and fourth feed locations. The maximum projection of the first wing (50*a*) from the ground plane (12) is no greater than the maximum projection of the second planar disk (18) from the ground plane (12).

A antenna array according to an aspect of the invention comprises plural elemental antennas (10). Each of the elemental antennas (10) includes a plurality (two illustrated) of stacked, concentric, generally planar antenna elements (12, 14). Each of the antenna elements (12, 14) includes a first wing (50*a*) generally defining a plane orthogonal to the plane (or planes) of the planar antenna elements and also includes a second wing (50*b*) generally defining a plane orthogonal to the plane of the antenna elements. The first (50*a*) and second (50*b*) wings are coplanar, with the axis of concentricity (8) of the planar antenna elements (12, 14) lying in the plane of the first (50*a*) and second (50*b*) wings. The plurality of elemental antennas (10) is arrayed in a planar manner, with no wing (50*a* or 50*b*) of any elemental antenna (10) lying directly between the axes of concentricity (8) of adjacent ones of the elemental antennas.

An antenna array according to another aspect of the invention comprises a plurality of elemental antennas (10) arrayed in a plane. Each of the elemental antennas (10) includes stacked, concentric, generally planar antenna elements (12, 14). Each of the elemental antennas (10) includes a first wing (50*a*) generally defining a plane orthogonal to the planes of the antenna elements (12, 14) and a second wing (50*b*) also generally defining a plane orthogonal to the planes of the antenna elements. The first (50*a*) and second (50*b*) wings are coplanar, with the axis of concentricity (8) lying in the common plane of the first (50*a*) and second (50*b*) wings. The arraying of the plurality of elemental antennas (10) is such that the wings of the elemental antennas lie at least partially between adjacent ones of the antenna elements. In a most preferred embodiment, both wings are metallic or dielectric, or the first wing is metallic and the second wing is dielectric. The dielectric of the wings is high-dielectric-constant material. The first wing may have a generally rectangular outline.

In an antenna array or subarray according to an aspect of the invention, the antenna array or subarray comprises a plurality of elemental antennas. Each of the elemental antennas (10) comprises:

(a) a generally planar ground plane (12);

(b) an electrically conductive first planar disk (14) lying parallel with the ground plane (12) and spaced therefrom by a first distance (S1), the first planar disk (14) defining a feed side facing the ground plane (12);

(c) an electrically conductive second planar disk (18) lying parallel with the ground plane (12) and spaced therefrom by a second distance (S2), greater than the first distance (S1), the second planar disk (18) being registered with the first planar disk (14);

(d) an elongated thermally and electrically conductive element (30) thermally and electrically coupled to a first location on the ground plane (12) and extending perpendicular to the ground plane (12) along a central axis (8), and making thermal and electrical contact with the center of the first planar disk (14) and with the center of the second planar disk (18); and (e) at least first and second feed conductors making contact with the feed side of the first planar disk (14) at first and second feed locations lying on a first line extending through the central axis (8).

The generally planar ground plane (12) of the elemental antennas (10) is electrically continuous across the array or subarray. The first and second feed conductors of each of the elemental antennas of the array or subarray are fed with the same phase progression as other antenna elements of the array or subarray. In one embodiment of such an array or subarray, the elongated thermally conductive element (30) is additionally electrically conductive, and is electrically and thermally coupled to a first location on the ground plane (12) and makes electrical and thermal contact with the center (14*c*) of the first planar disk (14) and with the center (18*c*) of the second planar disk (18). An embodiment may further comprise a radome (60) extending over the second planar disk (18) of each elemental antenna of the array or subarray, which radome is in thermal communication with the second planar disk (18) and the thermal element (30) of each antenna element (10) of the array or subarray. In one version, each elemental antenna (10) of the antenna array (500) or subarray further comprises at least a first wing (50*a*) supported by the ground plane (12), which first wing (50*a*) is oriented so that the central axis (8) lies in a plane thereof. The first wing (50*a*) may lie outside of the projection, parallel with the central axis (8), of the second planar disk (18). The plane of the first wing (50*a*) may lie equidistant from the first (14*a*) and second (14*b*) feed locations. A second wing (50*b*) may be included, in which case the first wing (50*a*) may be electrically conductive and the second wing (50*b*) may be of a metal or dielectric material.

What is claimed is:

1. An antenna element, comprising:

a generally planar ground plane;

an electrically conductive first planar disk lying parallel with said ground plane and spaced therefrom by a first distance, said first planar disk defining a feed side facing said ground plane;

an electrically conductive second planar disk lying parallel with said ground plane and spaced therefrom by a second distance, greater than said first distance, said second planar disk being registered with said first planar disk;

an elongated thermally and electrically conductive element thermally and electrically coupled to a first location on said ground plane and extending perpendicular to said ground plane along a central axis, and making thermal contact with the center of said first planar disk and with the center of said second planar disk; and at least first and second feed conductors making contact with said feed side of said first planar disk at first and second feed locations lying on a first line extending through said central axis.

2. An antenna element according to claim 1, further comprising a locally planar radome overlying and thermally coupled to said second planar disk and said thermally conductive element.

3. An antenna element according to claim 1, wherein said elongated thermally conductive element is electrically conductive, and additionally makes electrical contact with centers of said first and second disks and with said ground plane.

4. An antenna element according to claim 3, wherein said first and second feed locations are equidistant from said central axis.

5. An antenna according to claim 4, wherein said first wing defines a plane orthogonal to said ground plane.

6. An antenna element according to claim 5, wherein said both wing are metallic.

7. An antenna element according to claim 5, wherein said first wing is metallic and said second wing is dielectric.

8. An antenna element according to claim 5, wherein both said wings are dielectric.

9. An antenna element according to claim 5, wherein said first wing has a generally rectangular outline.

10. An antenna element according to claim 3, further comprising at least a first wing supported by said ground plane, said first wing being oriented so that said central axis lies in the plane thereof, said first wing lying outside of the projection, parallel with said central axis, of said second planar disk, and wherein said plane of said first wing lies equidistant from said first and second feed locations.

11. An antenna element according to claim 10, further comprising at least a second wing supported by said ground plane, said second wing lying in the same plane as said first wing, said second wing lying outside of the projection, parallel with said central axis, of said second planar disk, and diametrically opposite to said first wing about said central axis.

12. An antenna element according to claim 1, wherein said first and second feed conductors comprise lesser conductors of first and second unbalanced feed transmission lines, each defining a greater conductor, the greater conductors of which first and second unbalanced feed transmission lines make electrical contact with said ground plane at first and second feedthrough locations, which first and second feedthrough locations are projections, parallel with said central axis, onto said ground plane from said first and second feed locations, respectively.

13. An antenna element according to claim 12, wherein said first and second feedthrough locations are locations at which said center conductors of said first and second coaxial transmission lines extend through said ground plane.

14. An antenna element according to claim 13, wherein said first and second feed locations are equidistant from said central axis.

15. An antenna element according to claim 13, wherein said third and fourth feed locations are equidistant from said central axis.

16. An antenna element according to claim 13, wherein said first, second, third, and fourth feed locations are equidistant from said central axis.

17. An antenna element according to claim 16, further comprising a locally planar radome overlying and thermally coupled to said second planar disk and to said thermally conductive element.

18. An antenna element according to claim 17, further comprising at least a first wing supported by said ground plane, said first wing defining a plane orthogonal to said ground plane and being oriented so that said central axis lies in said plane of said first wing, said first wing lying outside of the projection, parallel with said central axis, of said second planar disk.

19. An antenna element according to claim 17, wherein said plane of said first wing lies equidistant from said third and fourth feed locations.

20. An antenna element according to claim 17, wherein said plane of said first wing lies equidistant from said first, second, third, and fourth feed locations.

21. An antenna element according to claim 20, wherein said first wing is electrically conductive.

22. An antenna element according to claim 20, wherein said first and second feed locations are equidistant from said central axis.

23. An antenna element according to claim 20 wherein said first wing has a generally rectangular outline.

24. An antenna element according to claim 23, wherein said third and fourth feed locations are equidistant from said central axis.

25. An antenna element according to claim 24, wherein said plane of said first wing lies equidistant from said first, second, third, and fourth feed locations.

26. An antenna element according to claim 23, wherein said first, second, third, and fourth feed locations are equidistant from said central axis.

27. An antenna element according to claim 20, further comprising third and fourth feed conductors, said third and fourth feed conductors making contact with said feed side of said first planar disk at third and fourth feed locations lying on a second line extending through said central axis and perpendicular to said first line extending from said first feed location to said second feed location.

28. An antenna element according to claim 20, wherein the maximum projection of said first wing from said ground plane is no greater than the maximum projection of said second planar disk from said ground plane.

29. An antenna element according to claim 13, further comprising at least a first wing supported by said ground plane, said first wing being oriented so that said central axis lies in a plane thereof orthogonal to said ground plane, said first wing lying outside of the projection, parallel with said central axis, of said second planar disk, and wherein said plane of said first wing lies equidistant from said first, second, third, and fourth feed locations.

30. An antenna element according to claim 1, wherein said first and second feed conductors comprise center conductors of first and second feed coaxial transmission lines each defining an outer conductor, the outer conductors of which first and second feed coaxial transmission lines make electrical contact with said ground plane at first and second feedthrough locations, which first and second feedthrough locations are projections, parallel with said central axis, onto said ground plane from said first and second feed locations, respectively.

31. An antenna element according to claim 1, further comprising third and fourth feed conductors, said third and fourth feed conductors making contact with said feed side of said first planar disk at third and fourth feed locations lying on a second line extending through said central axis and perpendicular to said first line extending from said first feed location to said second feed location.

32. An antenna element according to claim 1, further comprising third and fourth feed conductors, said third and fourth feed conductors making contact with said feed side of said first planar disk at third and fourth feed locations lying on a second line extending through said central axis, said second line extending perpendicular to said first line extending from said first feed location to said second feed location;

wherein said first and second feed conductors comprise center conductors of first and second coaxial transmission feed lines each defining an outer conductor, the outer conductors of which first and second coaxial transmission lines make electrical contact with said ground plane at first and second particular locations which are projections, parallel with said central axis, onto said ground plane from said first and second feed locations, respectively;

wherein said third and fourth feed conductors comprise center conductors of third and fourth coaxial transmission feed lines each defining an outer conductor, the outer conductors of which third and fourth coaxial transmission lines make electrical contact with said ground plane at third and fourth particular locations which are projections, parallel with said central axis, onto said ground plane from said third and fourth feed locations, respectively.

33. An antenna element according to claim 32, wherein said first wing is electrically conductive.

34. An antenna element according to claim 33, wherein said first wing is metallic and said second wing is metallic.

35. An antenna element according to claim 33, wherein said first wing is metallic and said second wing is high-dielectric-constant material.

36. An antenna element according to claim 33, wherein said first wing is high-dielectric-constant material and said second wing is high-dielectric-constant material.

37. An antenna element according to claim 32, further comprising at least a second wing supported by said ground plane, said second wing lying in the same plane as said first wing, said second wing lying outside of the projection, parallel with said central axis, of said second planar disk, and diametrically opposite to said first wing about said central axis.

38. An antenna element according to claim 32, wherein the maximum projection of said first wing from said ground plane is no greater than the maximum projection of said second planar disk from said ground plane.

39. An antenna element according to claim 32, wherein said plane of said first wing lies equidistant from said first and second feed locations.

40. An antenna element, comprising:

a generally planar ground plane;

an electrically conductive first planar disk lying parallel with said ground plane and spaced therefrom by a first distance, said first planar disk defining a feed side facing said ground plane and being centered on a central axis of said antenna element;

an electrically conductive second planar disk lying parallel with said ground plane and spaced therefrom by a second distance, greater than said first distance, said second planar disk being centered on said central axis;

at least first and second feed conductors making contact with said feed side of said first planar disk at first and second feed locations lying on a first line extending through said central axis; and at least a first wing supported by said ground plane, said first wing being oriented so that said central axis lies in a plane thereof orthogonal to said ground plane.

41. An antenna element according to claim 40, wherein said first wing includes a metallic component.

42. An antenna element according to claim 41, wherein said first wing lies outside of the projection, parallel with said central axis, of said second planar disk, and wherein said plane of said first wing lies equidistant from said first and second feed locations.

43. An antenna array, comprising:

a plurality elemental antennas, each of said elemental antennas including a plurality of stacked, concentric, generally planar antenna elements, each of said elemental antennas including a first wing generally defining a plane orthogonal to the plane of said planar antenna elements and also including a second wing generally defining a plane orthogonal to said plane of said antenna elements, said first and second wings being coplanar, with the axis of concentricity of said planar antenna elements lying in the plane of said first and second wings;

said plurality of elemental antennas being arrayed in a planar manner, with no wing of any element lying directly between said axes of concentricity of adjacent ones of said antenna elements.

44. An antenna array, comprising:

a plurality of elemental antennas, each of said elemental antennas comprising a plurality of stacked, concentric, generally planar antenna elements, each of said elemental antennas including a first wing generally defining a plane orthogonal to the planes of said antenna elements and a second wing generally defining a plane orthogonal to the planes of said antenna elements, said first and second wings being mutually coplanar, with the axis of concentricity lying in the common plane of said first and second wings;

said plurality of elemental antennas being arrayed in a planar manner, so that each of said wings of one of said antenna elements lies at least partially between adjacent ones of said antenna elements; and one of said first generally planar wings of each of said elemental antennas being electrically conductive, or dielectric and the second being dielectric or conductive.

45. An antenna array or subarray according to claim 44, wherein said elongated thermally conductive element is additionally electrically conductive, and is electrically and thermally coupled to a first location on said ground plane and making electrical and thermal contact with the center of said first planar disk and with the center of said second planar disk.

46. An antenna array or subarray, said antenna array or subarray comprising a plurality of elemental antennas, each of said elemental antennas comprising:

(a) a generally planar ground plane;

(b) an electrically conductive first planar disk lying parallel with said ground plane and spaced therefrom by a first distance, said first planar disk defining a feed side facing said ground plane;

(c) an electrically conductive second planar disk lying parallel with said ground plane and spaced therefrom by a second distance, greater than said first distance, said second planar disk being registered with said first planar disk;

(d) an elongated thermally conductive element thermally coupled to a first location on said ground plane and extending perpendicular to said ground plane along a central axis, and making thermal contact with the center of said first planar disk and with the center of said second planar disk; and (e) at least first and second feed conductors making contact with said feed side of said first planar disk at first and second feed locations lying on a first line extending through said central axis;

said generally planar ground planes of said elemental antennas being continuous across said array or subarray; and said first and second feed conductors of each of said elemental antennas of said array or subarray being fed with the same phase progression as other antenna elements of said array or subarray.

47. An antenna array or subarray according to claim 44, further comprising a radome extending over said second planar disks of each elemental antenna of said array or subarray and in thermal communication with said second planar disk and said thermal element of each elemental antenna of said array or subarray.

48. An antenna array or subarray according to claim 47, wherein said first wing is one of electrically conductive and dielectric.

49. An antenna array or subarray according to claim 48, wherein said first wing is electrically conductive and said second wing is dielectric.

50. An antenna array or subarray according to claim 47, wherein each of said elemental antennas further comprises at least a second wing supported by said ground plane, said second wing lying in the same plane as said first wing, said second wing lying outside of the projection, parallel with said central axis, of said second planar disk, and diametrically opposite to said first wing about said central axis.

51. An antenna array or subarray according to claim 44, wherein:

each of said elemental antennas further comprises at least a first wing supported by said ground plane, said first wing being oriented so that said central axis lies in a plane thereof which is orthogonal to said ground plane, said first wing lying outside of the projection, parallel with said central axis, of said second planar disk, and wherein the plane of said first wing lies equidistant from said first and second feed locations.

* * * * *